US006523970B1

(12) United States Patent
Scales, III

(10) Patent No.: US 6,523,970 B1
(45) Date of Patent: Feb. 25, 2003

(54) SPOTLIGHT ADAPTOR

(76) Inventor: Charles W. Scales, III, 1002 Parkins Mill Rd., Greenville, SC (US) 29607

( * ) Notice: Subject to any disclaimer, the term of this patent is extended or adjusted under 35 U.S.C. 154(b) by 0 days.

(21) Appl. No.: 09/971,330

(22) Filed: Oct. 4, 2001

(51) Int. Cl.[7] ..... F21S 8/06; F21V 21/28

(52) U.S. Cl. ..... 362/145; 362/250; 362/226; 362/404; 362/430; 439/643

(58) Field of Search ..... 439/641, 642, 439/643; 362/235–239, 233, 249, 250, 252, 226, 145, 147, 404, 427, 429, 430

(56) References Cited

U.S. PATENT DOCUMENTS 762,535 A * 6/1904 Kelsey ..... 362/249
4,053,761 A * 10/1977 Brinkley ..... 362/404
5,186,659 A * 2/1993 Hefner ..... 439/643
5,203,626 A * 4/1993 Clement ..... 362/250
5,623,789 A * 4/1997 Kidwell et al. ..... 362/147
5,632,553 A * 5/1997 Huang ..... 362/250
5,772,315 A * 6/1998 Shen ..... 362/404
6,007,215 A * 12/1999 Aizen ..... 362/145
6,244,733 B1 * 6/2001 Fong et al. ..... 362/147

* cited by examiner

*Primary Examiner*—Alan Cariaso
(74) *Attorney, Agent, or Firm*—Charles L. Schwab; Nexsen Preut Jacobs & Pollard, LLC

(57) ABSTRACT

A spotlight adaptor with a flexible conduit, which can be shaped to direct light to be directed around the comer of a building. The spotlight adapter can be screwed into an electric socket mounted at one side of and near to a comer of a building and includes a flexible conduit which can be bent around the comer of the building to provide illumination at the other side of the building.

6 Claims, 2 Drawing Sheets

SPOTLIGHT ADAPTOR

TECHNICAL FIELD

This invention relates to spotlights and particularly to a spotlight adaptor by which two sides of a building are adequately illuminated from a single electric outlet socket.

BACKGROUND OF THE INVENTION

Many homes and detached garages are built with a single spotlight positioned close to a comer of the building. Such installations provide lighting for one side of the building but do not provide adequate illumination for both sides extending from the comer. The presence of a downspout at the comer further hinders illumination.

OBJECTS AND SUMMARY OF THE INVENTION

It is a primary object of this invention to provide a spotlight adaptor by which two adjacent sides of a building may be adequately illuminated from a single light socket. It is a further object of this invention to provide a spotlight adaptor, which is reliable and low in cost.

The spotlight adaptor of this invention is particularly suited for use with a spotlight fixture of the type having a base which is fixedly secured to an exterior wall of a building and which has an electric light socket. The spotlight adaptor includes a rigid conduit having an externally threaded end for threaded and electrical contact with the light socket of the base attached to one side of the building and an electric socket on its other end for receiving a first spotlight bulb. A flexible conduit is secured at one end to an intermediate part of the rigid conduit and has an electric socket at its free end for receiving a second spotlight bulb. The flexible conduit is sufficiently long to permit it to be bent around the comer so that the light of the second spotlight illuminates the area alongside the wall at the other side of the building.

BRIEF DESCRIPTION OF THE DRAWINGS

One embodiment of the invention is illustrated in the drawings in which.

DETAILED DESCRIPTION OF THE INVENTION

Figure 2:
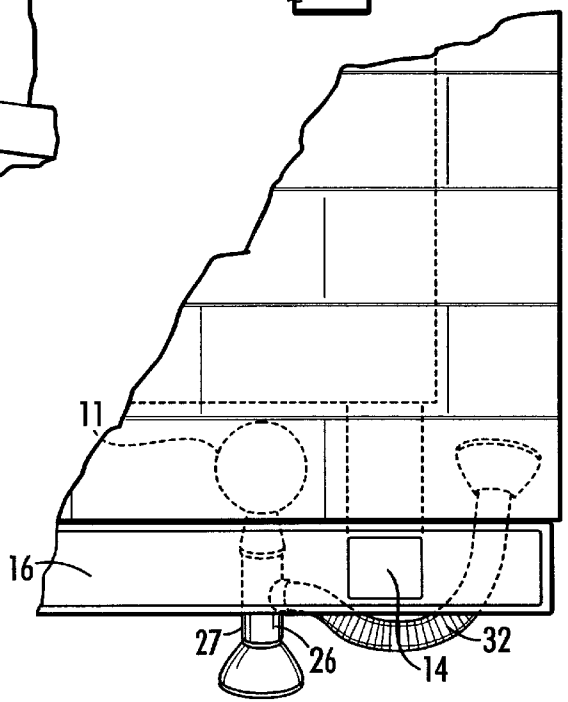
FIG. 2 is a view looking down on the comer of the building shown in FIG. 1
Figure 1:
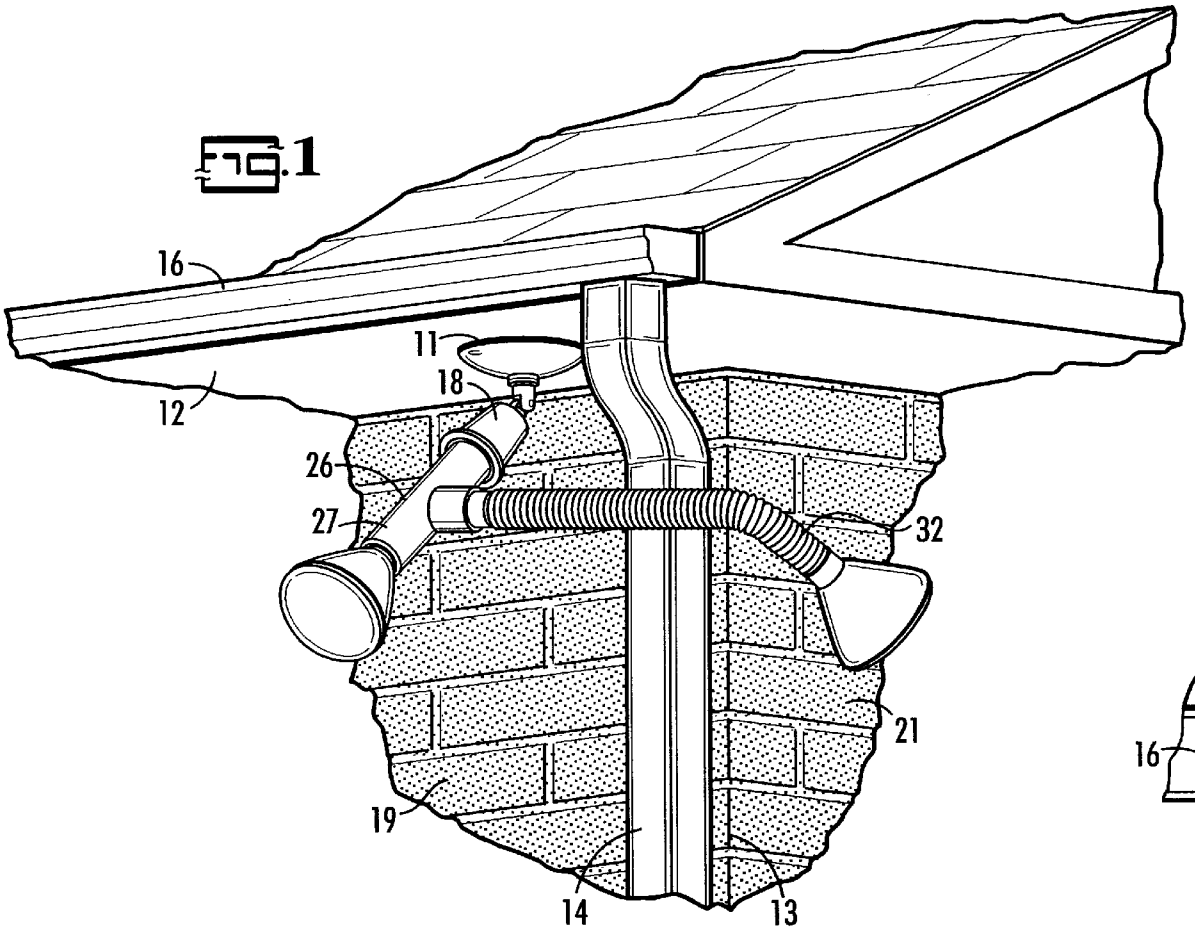
FIG. 1 is a perspective view of the spotlight adaptor mounted in an electric socket near a comer of a building.
Figure 3:
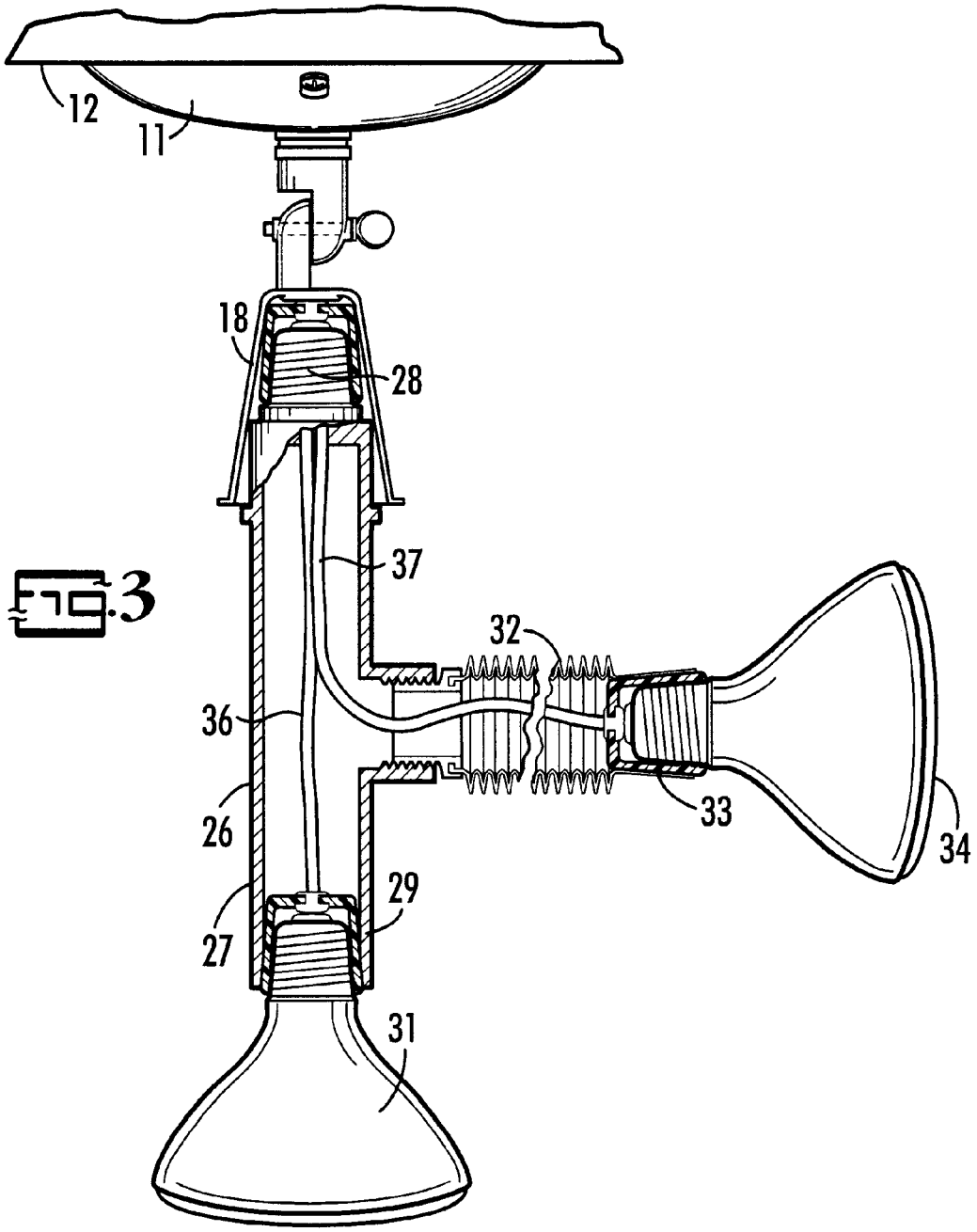
FIG. 3 is a view of the spotlight adaptor installed in a light socket with parts broken away to show details of construction.

Referring to the drawings, a spotlight base 11 is fixedly secured to an underside 12 of an overhang of a building roof near a comer 13 at which a downspout 14 is installed near one end of a gutter 16. An electric spotlight socket 18 is secured to the base 11 for universal adjustment. If a standard spotlight bulb is installed in the electric socket 18 it would be capable of illuminating the area alongside the side wall 19 of the illustrated building but would not provide adequate illumination of the area alongside the adjacent side wall 21 of the building. However, by using the spotlight adaptor 26 of this invention, the area alongside the wall 21 can also be illuminated.

The spotlight adaptor 26 includes an end part in the form of a rigid conduit 27 having an externally threaded end 28 in threaded engagement with the light socket 18 and an intemally threaded electric socket 29 at its other end in which a spotlight or spotlight bulb 31 is installed. An elongated flexible conduit 32 is rigidly secured at one of its ends to an intermediate portion of the rigid conduit 26 and its other end carries an electric socket 33 adapted to receive a spotlight bulb 34. The threaded end 28 of the rigid conduit 26 is electrically connected to the electric sockets 29, 33 in a conventional manner by suitable electric leads or conductors 36, 37. The flexible conduit 32 is preferably made of a suitable metal and remains in the shape to which it is bent or altered by predetermined human effort until subjected to further bending effort of predetermined magnitude.

PRACTICAL APPLICATION

Many homes and garages are provide with an out-door spotlight installation near a comer of the building to provide light at the comer or on the one side of the comer. The usual spotlight installation near a comer of a building does not afford adequate illumination at both sides of the comer and the lighting deficiency is increased if a downspout is present at the comer. For security and safety reasons it is often desirable to provide illumination at both sides of a building adjacent a corner thereof.

The spotlight adaptor 26 with its deformable flexible conduit is capable of providing adequate illumination on two adjacent sides of a building. This superior illumination is achieved without the cost of a second spotlight installation on the other side of the comer; which would entail the cost of the necessary additional wiring and work of a qualified or licensed electrician.

What is claimed is:

1. A spotlight adaptor for a spotlight installation having a base secured to a building at one side of a comer of said building and a first threaded electric socket secured to said base, said adaptor including an externally threaded end part adapted for threaded and electrical connection with said first electric socket and a flexible conduit part having one end rigidly secured to said end part and a free end to which a second threaded electric socket is secured, said second electric socket being connected electrically with said first electric socket and adapted to receive an electric spotlight bulb, said flexible conduit being sufficiently long to permit it to be bent around the comer of said building to illuminate the other side of said comer, said flexible conduit remaining in a configuration to which it is bent until subjected to further bending effort exceeding a predetermined magnitude.

2. The spotlight adaptor of claim 1 wherein said externally threaded end part includes arigid conduit segment with a free end presenting a third threaded electric socket connected electrically with said externally threaded end part and adapted to receive a spotlight bulb.

3. The spotlight adaptor of claim 1 wherein said flexible conduit is sufficiently long to permit it to be placed in partial encirclement of a downspout at said corner of said building.

4. The spotlight adaptor of claim 3 wherein said externally threaded end part includes a rigid conduit segment with a free end presenting a third threaded electric socket adapted to receive a spotlight bulb.

5. The spotlight adaptor of claim 1 wherein said flexible conduit is at least 14 inches long.

6. A spotlight installation comprising:

a base adapted for attachment to a building near its comer and having a first threaded electric socket, an elongated rigid conduit having an externally threaded end adapted for a threaded and electrical connection with said first electric socket, an internally threaded end forming a second electric socket for receiving an electric spotlight bulb, a first pair of electric conductors interconnecting said externally threaded end and said second electric socket, an elongated flexible conduit longer than said rigid conduit, said flexible conduit having one end secured to an intermediate part of said rigid conduit and a free end containing a second electrical socket adapted to receive an electric spotlight bulb, a second pair of electric conductors connecting said second electric socket with said first pair of electric conductors, said flexible conduit being sufficiently long to permit it to bend around a gutter downspout and said corner of said building, said flexible conduit remaining in a configuration to which it is bent until subjected to further bending effort exceeding a predetermined magnitude.

* * * * *